US007465201B1

(12) United States Patent
Thivierge et al.

(10) Patent No.: US 7,465,201 B1
(45) Date of Patent: Dec. 16, 2008

(54) ARTICULATION MECHANISM AND ELASTOMERIC NOZZLE FOR THRUST-VECTORED CONTROL OF AN UNDERSEA VEHICLE

(75) Inventors: Daniel P. Thivierge, Warren, RI (US); Richard E. Dooley, Portsmouth, RI (US); Alberico Menozzi, Middletown, RI (US); Allen L. Treaster, Julian, PA (US); Michael J. Beam, Tyrone, PA (US); Todd K. Fetterolf, Bellefonte, PA (US); Daniel R. Metrey, Port Matilda, PA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 640 days.

(21) Appl. No.: 11/239,442

(22) Filed: Sep. 6, 2005

Related U.S. Application Data

(60) Provisional application No. 60/612,395, filed on Sep. 20, 2004.

(51) Int. Cl.
*B63H 11/113* (2006.01)

(52) U.S. Cl. ..... 440/42; 114/166

(58) Field of Classification Search ..... 114/166, 114/337, 338; 440/38, 40, 42, 66, 67; 239/265.19, 239/265.35; 60/321, 322
See application file for complete search history.

(56) References Cited

U.S. PATENT DOCUMENTS 3,003,455 A * 10/1961 Alexander et al. ..... 440/42
3,192,715 A * 7/1965 Engel et al. ..... 60/222
4,046,097 A * 9/1977 Hornung ..... 440/67
4,106,425 A 8/1978 Gruber
4,427,393 A 1/1984 May
4,776,755 A 10/1988 Bjorkestam et al.
5,803,775 A 9/1998 Henmi
6,062,925 A 5/2000 Salmi et al.
6,174,210 B1 1/2001 Spade et al.
6,299,494 B1 10/2001 Bowers et al.
6,572,422 B2 * 6/2003 Kirkwood et al. ..... 440/67
6,716,075 B2 4/2004 Fuse et al.

* cited by examiner

*Primary Examiner*—Ed Swinehart
(74) *Attorney, Agent, or Firm*—James M. Kasischke; Michael P. Stanley; Jean-Paul A. Nasser

(57) ABSTRACT

The mechanism of the present invention maneuvers a vehicle by deflecting the flow from a propulsor of the vehicle. The mechanism has an elastomeric nozzle that encases the flow and is deflected via an articulation device mountable inside the vehicle. The nozzle is shaped and supported by spiral-wound composite to maintain a circular cross-section through a range of motion. An end of the nozzle is attached to the shroud of the propulsor and another end is supported by a ring with support struts radiating from a hub. The hub is supported by a shaft attached to a gimbal. The gimbal is constrained in movement by an outer race and an anti-rotation stud in a radial slot in a ball of the gimbal. A linkage as part of an articulation device controls rotation of the gimbal to direct movement of the shaft and enclosed nozzle thereby deflecting flow of the propulsor.

17 Claims, 8 Drawing Sheets

ARTICULATION MECHANISM AND ELASTOMERIC NOZZLE FOR THRUST-VECTORED CONTROL OF AN UNDERSEA VEHICLE

This application claims the benefit of U.S. Provisional Application No. 60/612,395 filed Sep. 20, 2004 and which is entitled ARTICULATION MECHANISM AND ELASTOMERIC NOZZLE FOR THRUST-VECTORED CONTROL OF AN UNDERSEA VEHICLE by Daniel Paul Thivierge, Allen Luther Treaster, Michael John Beam, Todd Kevin Fetterolf, Alberico Menozzi, Daniel R. Metrey and Richard E. Dooley.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention provides a mechanism to control the motion of underwater vehicles including submarines, torpedoes, and unmanned underwater vehicles (UUV's). The proposed mechanism provides thrust vectoring by redirecting the propulsor exhaust flow via a two-plane articulation mechanism deflecting an elastomeric exhaust nozzle.

(2) Description of the Prior Art

In the art, airfoil-shaped control surfaces are used to direct the movement of underwater vehicles by deflection of water flow across the contours of the control surfaces. These control surfaces are effective as long as the vehicle's velocity is two nautical miles per hour (knots) or faster. However, it is often desirable to maneuver at speeds less than two knots. Also, at times it is desired to possess enhanced maneuvering capabilities at speeds faster than two knots.

Another problem is that at high deflection angles, control surfaces can be a significant source of cavitation and noise. This cavitation and noise can occur at both high and low speeds.

As such, a need exists to provide a control mechanism that provides enhanced maneuvering capability while minimizing the effects of cavitation and noise normally caused when high deflection angles are used during propulsion.

SUMMARY OF THE INVENTION

Accordingly, it is a general purpose and object of the present invention to provide a mechanism that delivers enhanced maneuvering capabilities at high and low speeds.

It is a further object of the present invention to provide a mechanism that minimizes the effects of cavitation and noise during maneuvering.

It is a still further object of the present invention to provide a mechanism that delivers enhanced maneuvering capabilities and is suitable for use on vehicles such as submarines, torpedoes, and unmanned underwater vehicles (UUV's).

In order to attain the objects described above, the proposed mechanism converts linear motion of actuators to rotational motion thru bulkheads and seals. Rotational motion is then converted back to linear motion and drives tie rods attached to a gimbal mechanism in turn deflecting an elastomeric nozzle.

Generally, the device of the present invention provides thrust vectoring by redirecting a propulsor exhaust flow via an articulation mechanism deflecting the elastomeric exhaust nozzle. The nozzle encases the propulsor exhaust flow and directs the flow to the desired vector. The nozzle itself is preferably fabricated from an elastomer such as Navy red rubber and internally shaped and supported by a spiral-wound fiberglass-based composite. This fabrication allows the nozzle to maintain the needed cross-sectional area during vectoring.

An end of the nozzle is attached to the duct or shroud of the propulsor of the vehicle. The opposite end of the nozzle is supported by a ring with radial airfoil-shaped support struts radiating from a central hub. The support struts de-swirl the through flow of water to eliminate rotational moments on the vehicle.

More specifically, the drive hardware of the articulation mechanism rotates on a gimbal bearing and is driven by two linear electric actuators operating through a linkage system. The spherical gimbal bearing is supported through an outer race by a stationary aft end of the vehicle. The gimbal bearing is constrained by the outer race and by a stationary anti-rotation stud with a polymer anti-wear sleeve via a radial slot in a ball of the gimbal bearing. The constraint of the outer race, the anti-rotation stud, and the radial slot permit only two rotational degrees of freedom in the gimbal bearing.

The motion is generated in the gimbal bearing via two tie rods that are attached to the ball of the gimbal bearing by two smaller gimbal or tie rod bearings. The tie rod bearings are mounted in a vertical plane of the gimbal bearing. The angle between the lines connecting each of the tie rod bearings and the centerline of the gimbal bearing is 90 degrees.

The opposite end of the tie rods is mechanically connected to tie rod bearings. The bearings of the tie rods are attached to rotational linkages of the linkage system. The rotational linkages are respectively keyed to control shafts and clevis that are respectively actuated (rotated) by the electric linear actuators. By coordinating the motion between the two actuators, the central hub, struts and ring can be pivoted. The pivoting of the central hub struts and ring in turn pivots the nozzle within a volume contour of a cone with the included angle from the centerline of the cone to the surface of the cone being 25 degrees. Within this volume contour, the proposed mechanism provides thrust vectoring by redirecting the propulsor exhaust flow and thereby delivering enhanced maneuvering capabilities at high and low speeds.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DESCRIPTION OF THE PREFERRED EMBODIMENT

Most underwater vehicles are propelled by a propulsor at the aft end of the vehicle. The propulsor may have one or two rotating propellers and may also operate in a ducted configuration. These propulsors create an axial flow of water (along the vehicles centerline) with a speed greater than the forward speed of the vehicle.

Figure 1:
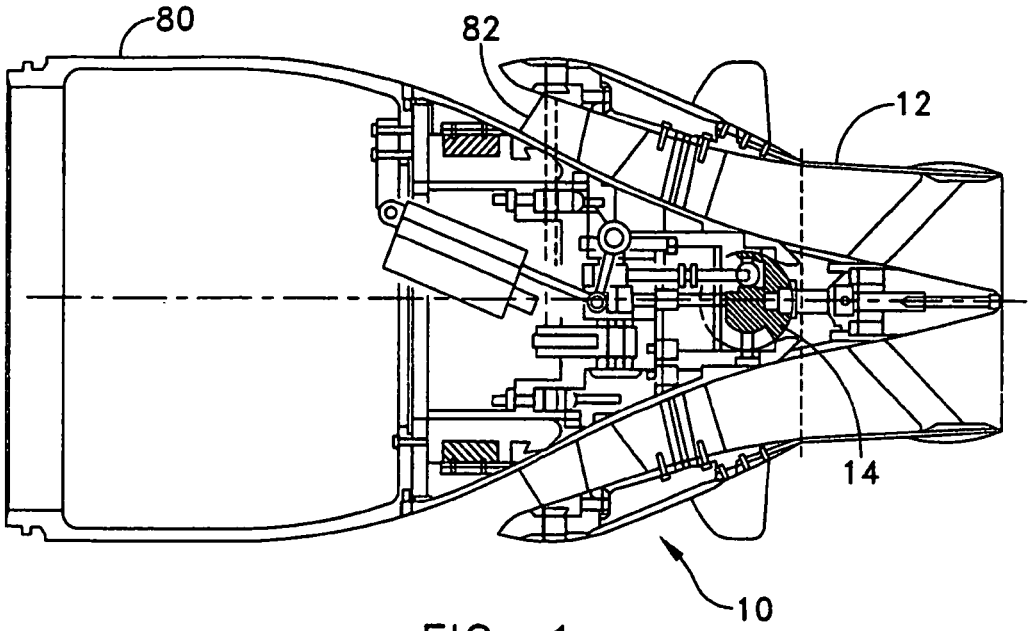
FIG. 1 is a cross-sectional view of the mechanism of the present invention positioned at the aft end of an undersea vehicle with some components of the vehicle removed for clarification.
Figure 2:
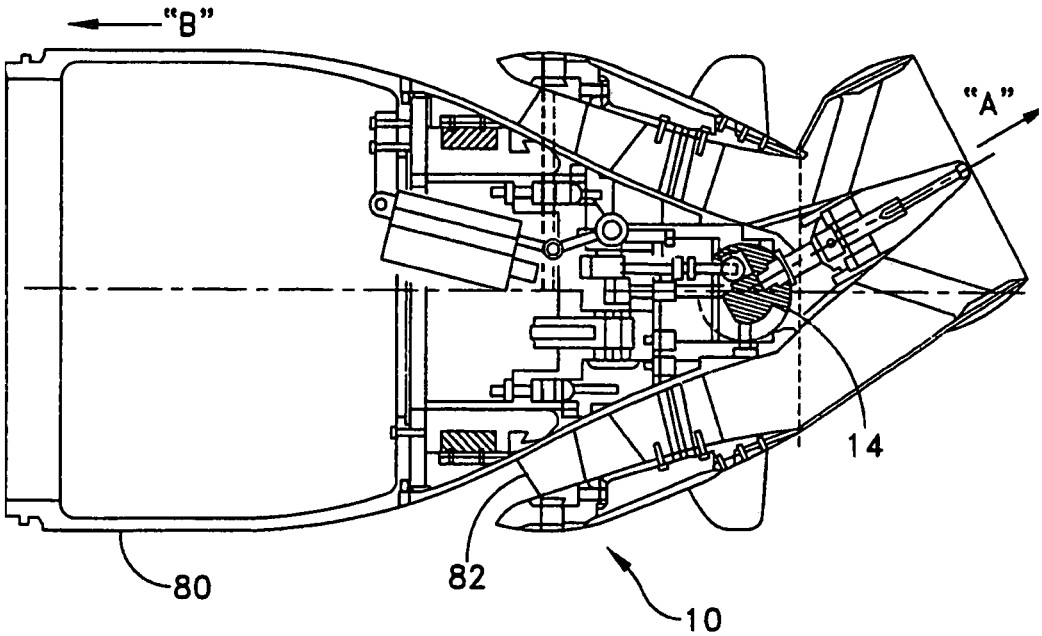
FIG. 2 is a cross-sectional view of the mechanism of the present invention positioned within the undersea vehicle with the nozzle of the mechanism deflected at a deflection angle and with some components of the vehicle removed for clarification.

As shown in FIGS. 1 and 2, the mechanism 10 of the present invention under consideration enables a simple means of maneuvering a vehicle 80 by deflecting the flow of water in the direction "A" at an angle opposite the desired motion "B" of the vehicle. Enhanced maneuvering capabilities are possible by briefly changing the rotational speed of a propeller 82 of the vehicle 80 during the maneuvering of the vehicle.

The mechanism 10 has a near cylindrical or frusto-conical elastomeric boot or nozzle 12 that encases the propulsor exhaust flow, identical in direction to water flow direction "A". The nozzle 12 is shaped to match the predicted geometry of an undeflected propulsor exhaust jet.

The elastomeric nozzle 12 is deflected via an articulation device 14 mounted inside the vehicle 80. As will be further described below; the articulation device 14 features tail cone/drive ring hardware which directly deflects the nozzle 12. As partially shown in FIGS. 3 and 4, the hardware of drive ring 15 rotates on a gimbal bearing 16 and is driven by two linear electric actuators 18, 20 operating through a linkage system 22.

The elastomeric nozzle 12, shown in varying directions in FIGS. 5-8 is shaped to match the exhaust flow field of the duct or shroud 84 of propulsor 86, and shapes in identical direction to water flow direction "A". The nozzle 12 is preferably fabricated from an elastomer such as Navy red rubber and internally shaped and supported by spiral-wound fiberglass-based composite. The nozzle 12 is designed to maintain its circular cross section through its full range of motion by pre-tensioning to more than 50% of its original state at assembly.

An end 24 with the larger diameter of the nozzle 12 is rigidly attached to the duct or shroud 84 of the propulsor 86 (which encompasses the propeller 82 of the propulsor). The nozzle 12 is attached and compressed using segmented clamp rings 25 or other suitable clamping devices known to those skilled in the art.

Figure 3:
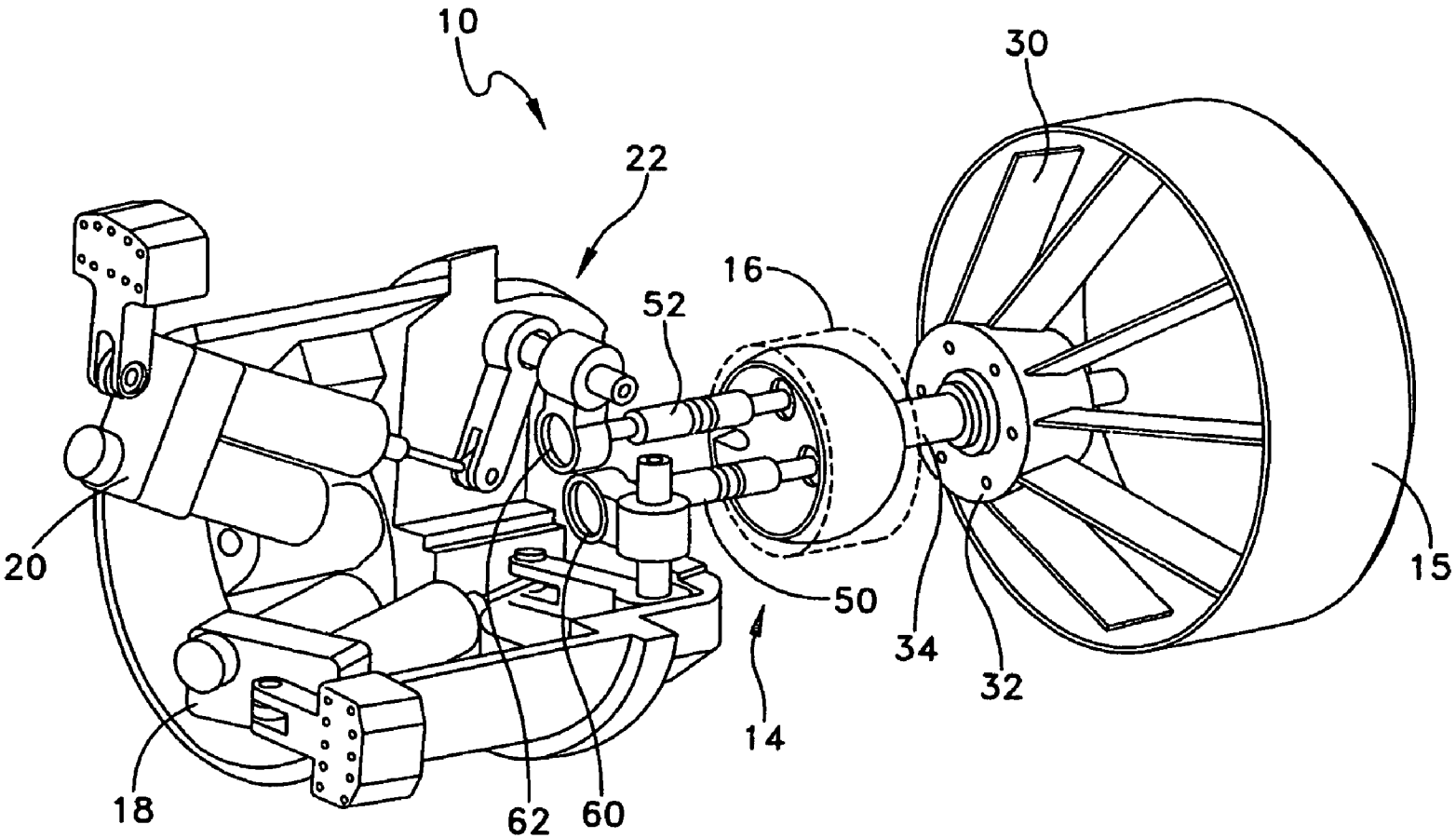
FIG. 3 is an isometric view of the articulation mechanism of the present invention.

An opposite end 26 of the nozzle 12, with a smaller diameter, is supported by the ring 15 with radial airfoil-shaped support struts 30 radiating from a central hub 32 (See FIG. 3). The support struts 30 de-swirl the through flow of water to eliminate rotational moments on the vehicle 80. The assembly of the hub 32, the struts 30 and the ring 15 is supported by a shaft 34 which is attached to the spherical gimbal bearing 16.

Figure 4:
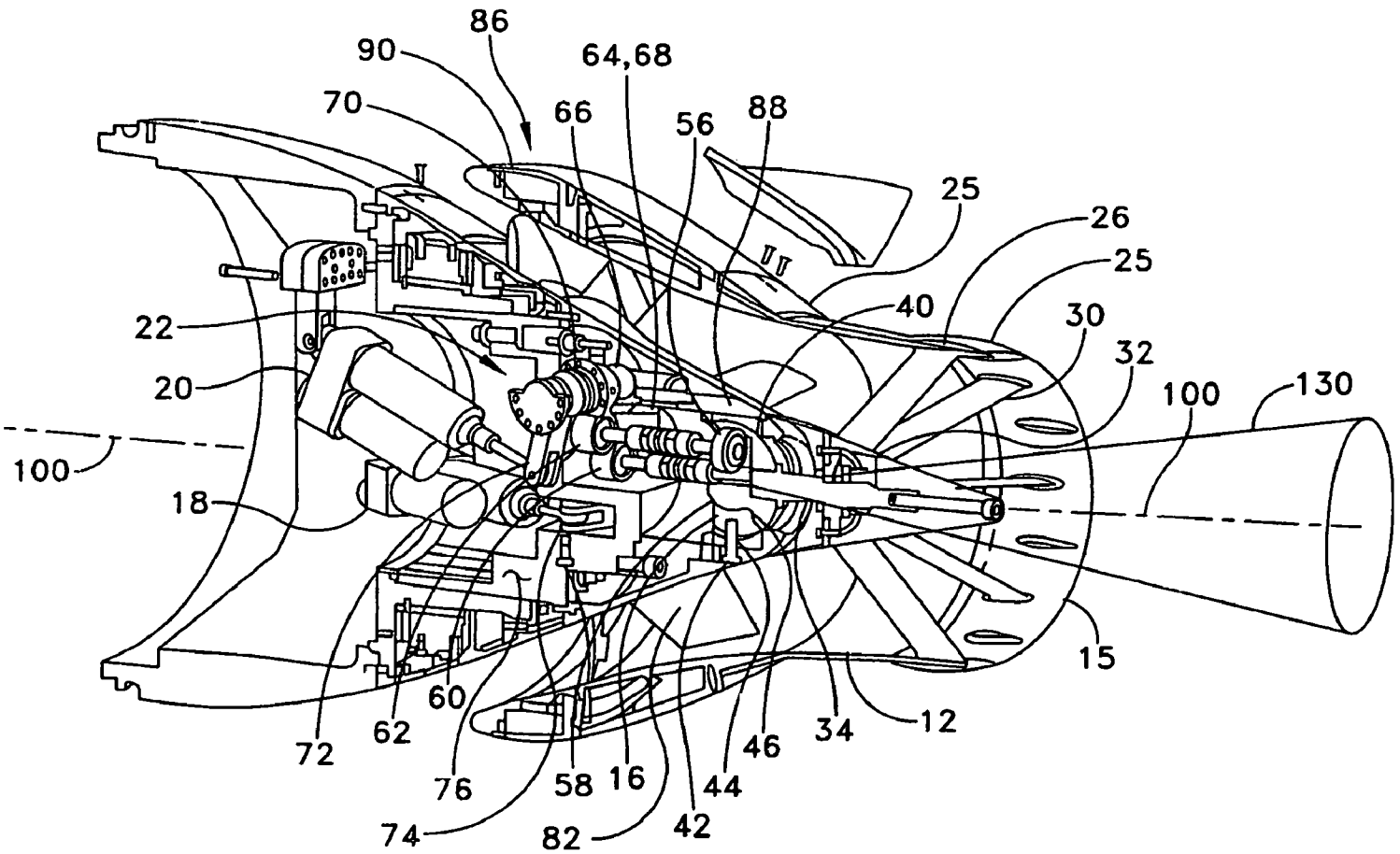
FIG. 4 is an alternate cross-sectional view of the mechanism of the present invention positioned within the undersea vehicle.
Figure 5:
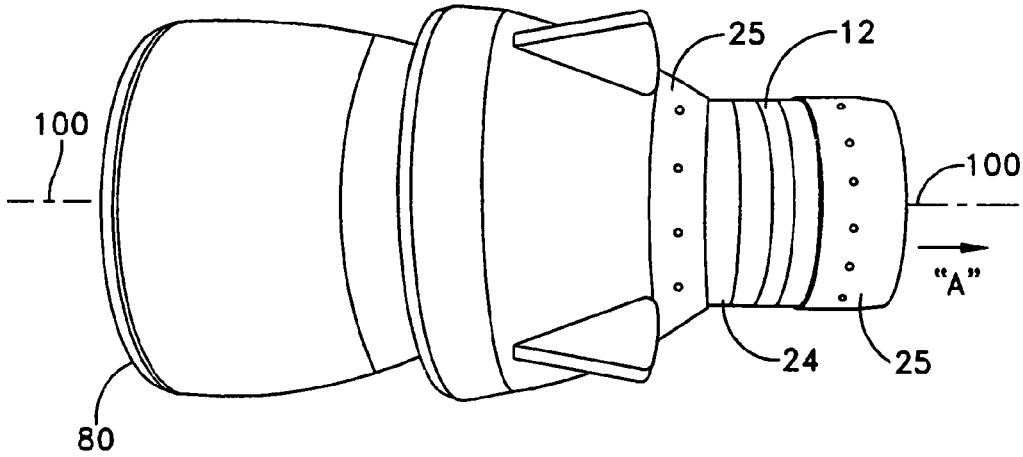
FIG. 5 is a side view of the mechanism of the present invention mechanically and operationally attached to the undersea-vehicle.
Figure 6:
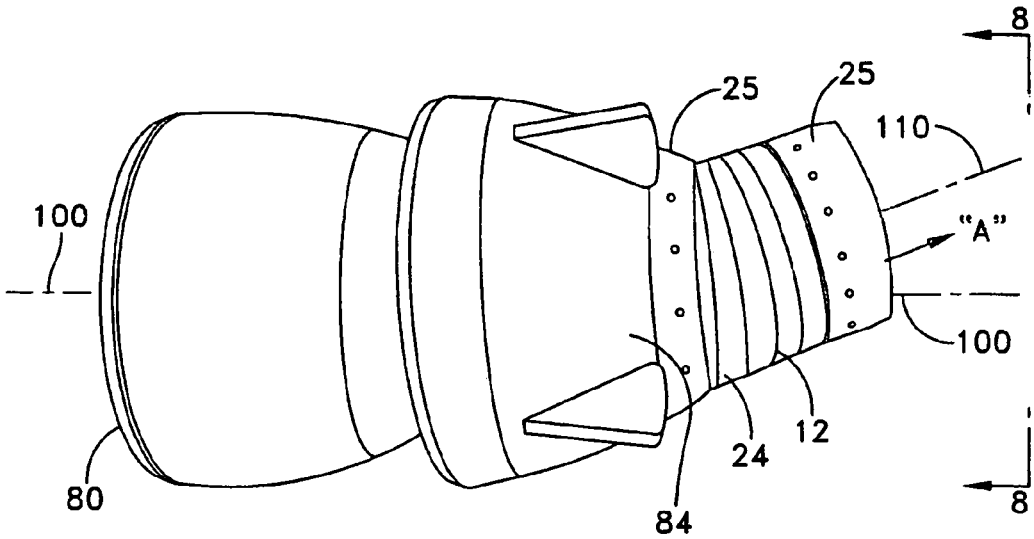
FIG. 6 is a side view of the mechanism of the present invention mechanically and operationally attached to the undersea vehicle with the nozzle of the mechanism deflected at a deflection angle and indicated plane.
Figure 7:
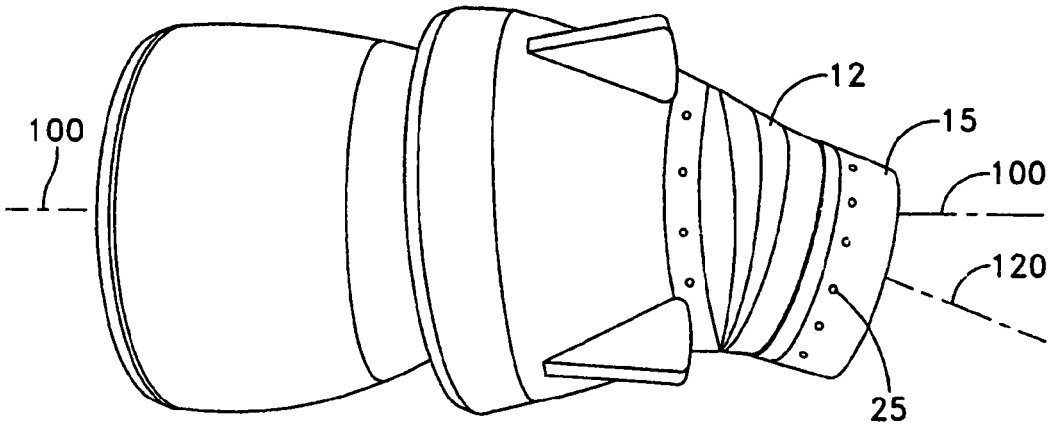
FIG. 7 is a side view of the mechanism of the present invention mechanically and operationally attached to the undersea vehicle with the nozzle of the mechanism deflected at an alternate deflection angle and indicated plane.
Figure 8:
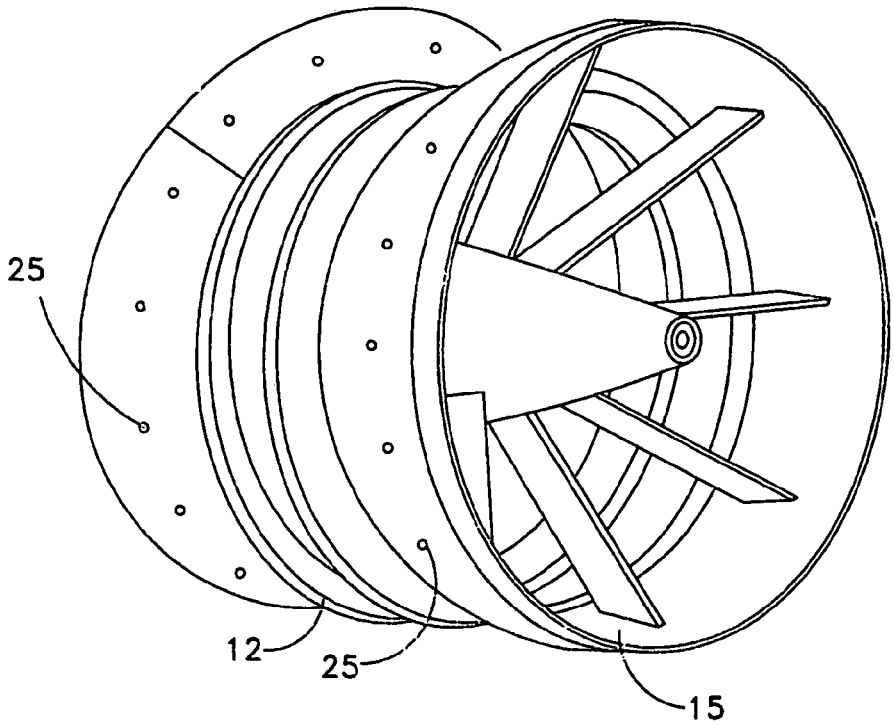
FIG. 8 is an end view of the mechanism of the present invention mechanically and operationally attached to the undersea vehicle with the nozzle of the mechanism deflected at a deflection angle representative of FIG. 6.
Figure 9:
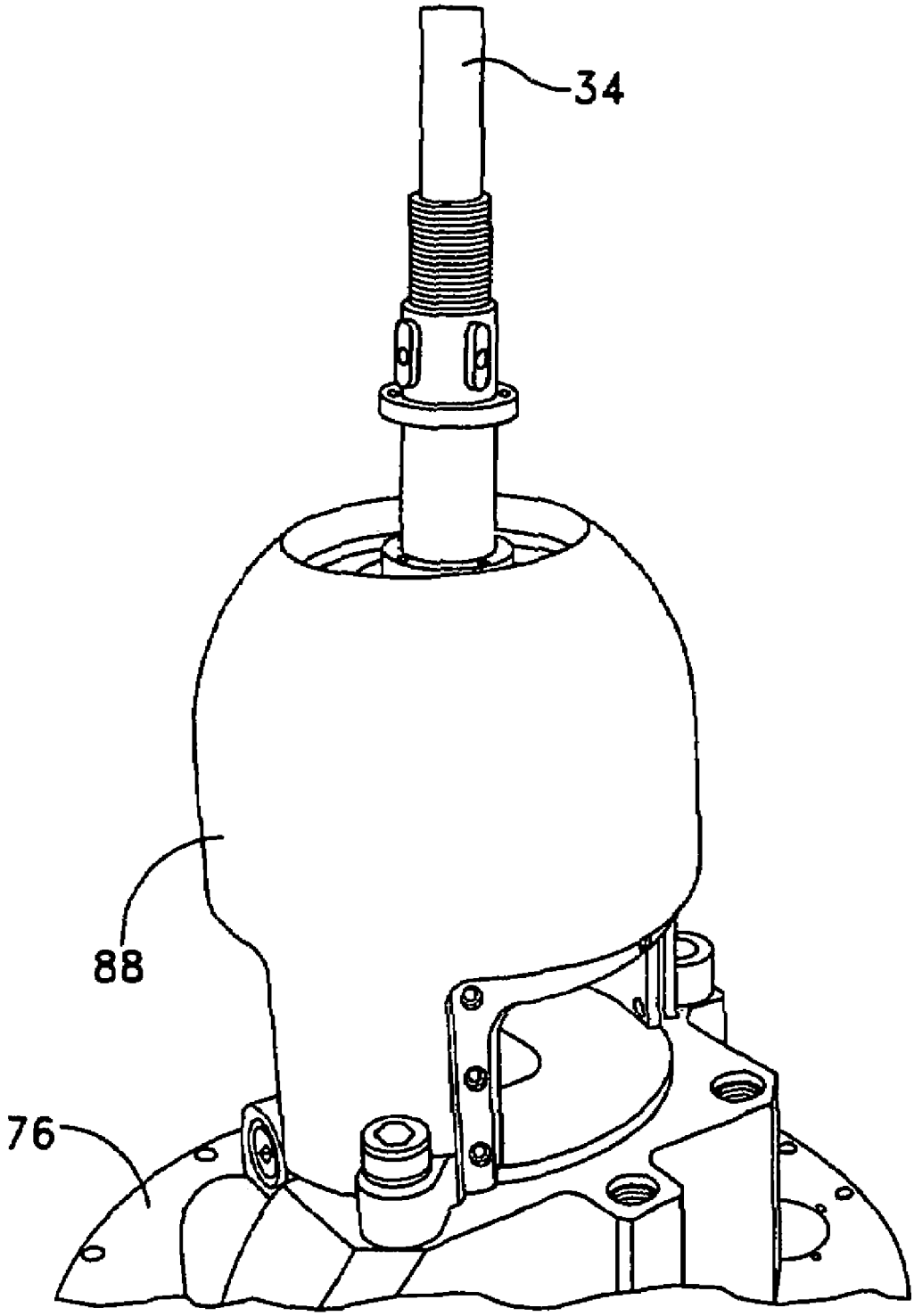
FIG. 9 is a view of the shaft of the mechanism of the present invention interfacing within a stationary aft end of the undersea vehicle.

The spherical gimbal bearing 16 is supported through an outer race 40 by a stationary aft end 88 of the vehicle 80 (See FIGS. 4 and 9). The gimbal bearing 16 is constrained by the outer race 40 and by a stationary anti-rotation stud 42 with a polymer anti-wear sleeve 44 via a radial slot 46 in a ball 48 of the gimbal bearing (See FIG. 10). The constraint of the outer race 40, the anti-rotation stud 42 and the radial slot 46 permit only two rotational degrees of freedom in the gimbal bearing 16.

The one rotational degree of freedom eliminated by the anti-rotation stud 42 is the axis of rotation about the vehicle centerline 100. Thus the shaft 34, support struts 30, and aft end 26 of the nozzle 12 are permitted to pivot about the center of the gimbal bearing 16 in any plane that contains the centerline 100 of the vehicle 80 (See example plane 110 in FIG. 6 and alternate example plane 120 in FIG. 7). The mechanism was designed to permit plus or minus 25 degrees of movement in any of these planes (See the representative position of the ring 15 of FIG. 8).

Figure 10:
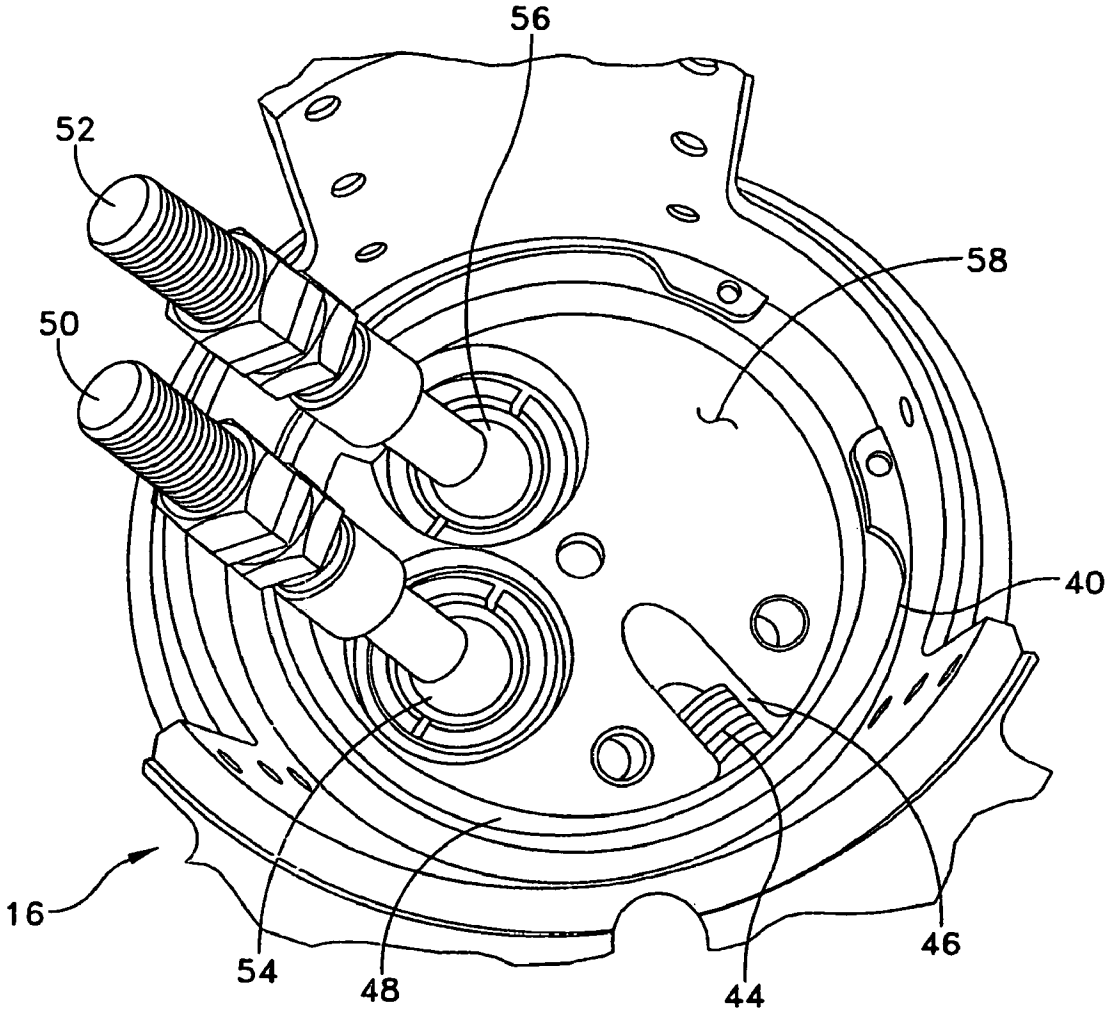
FIG. 10 is an end view of the gimbal bearing of the mechanism of the present invention illustrating the attachment points of the tie rods.
Figure 11:
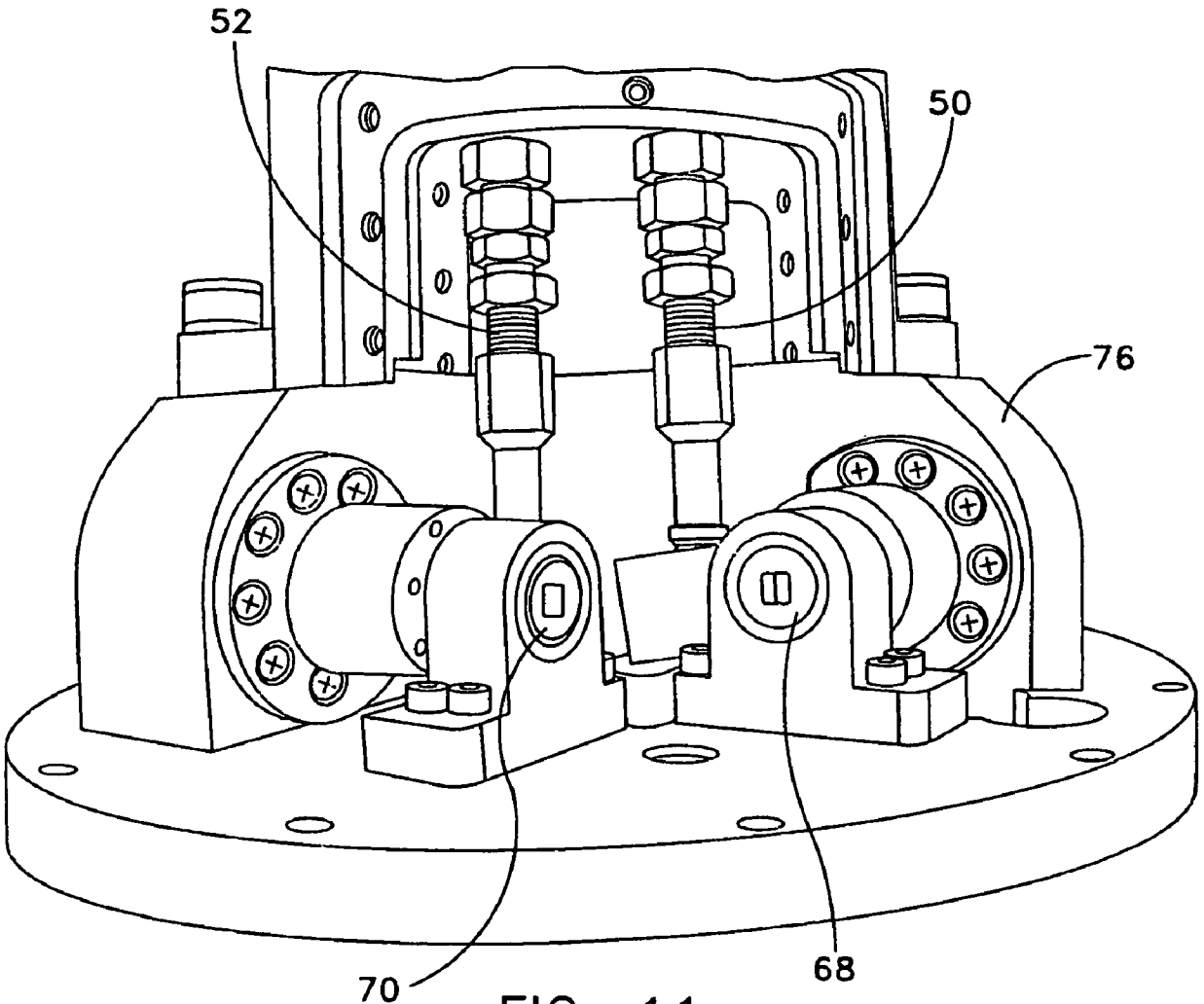
FIG. 11 is a view of the sealed bulkhead of the mechanism of the present invention.

The pivoting motion is generated in the gimbal bearing 16 via two tie rods 50, 52 that are attached to the ball 48 of the gimbal bearing by two smaller gimbal or tie rod bearings 54, 56 (See FIG. 10). The tie rod bearings 54, 56 are mounted in a vertical plane 58 as a face of the gimbal bearing 16. The angle between the lines connecting each of the tie rod bearings 54, 56 and the centerline of the gimbal bearing 16 is 90 degrees.

The opposite end of the tie rods 50, 52 is mechanically connected to tie rod bearings 60, 62. The bearings 60, 62 of the tie rods 50, 52 are attached to rotational linkages 64, 66 of the linkage system 22. The rotational linkages 64, 66 are respectively keyed to rotary control shafts 68, 70 and clevis 72, 74 that are respectively actuated (rotated) by the electric linear actuators 18, 20. By coordinating the motion between each of the actuators 18, 20, the central hub 32, struts 32 and ring 15 can be pivoted. The pivoting of the central hub 32, struts 32 and ring 15 in turn pivots the nozzle 12 within a volume contour of a cone with the included angle from the centerline of the cone to the surface of the cone being 25 degrees (See example volume 130 in FIG. 4). Within this volume contour, the proposed mechanism 10 provides thrust vectoring by redirecting the propulsor exhaust flow and thereby delivering enhanced maneuvering capabilities at high and low speeds.

An important detail to note is that one half of the mechanism 10 is exposed to undersea conditions and another half of the mechanism is isolated from undersea conditions. The nozzle 12, ring 15, shaft 34, gimbal bearing 16, tie rods 50, 52, linkages 64, 66, and one half of the rotary control shafts 68, 70 are exposed to undersea conditions. The rotary control shafts 68, 70 with the use of O-rings (typical of O-rings known to those skilled in the art) pass through a sealed bulkhead 76 to the clevis 72, 74 and linear actuators 18, 20 which are isolated from undersea conditions.

A propulsor with the mechanism 10 installed, eliminates the need for the vehicle velocity dependant control surfaces found on conventional propulsor designs. As a result, slow speed maneuvering is enhanced considerably. At elevated vehicles velocities, flow across the outside of the deflected nozzle further enhances the mechanism control effectiveness.

Also, the elimination of convention control surfaces and associate linkage mechanisms enables the use of a rim driven motor to drive the propeller thus saving significant volume in the vehicle 80 that could be used for added energy storage or payloads. A rim driven motor 90 is used in the propulsor 86 illustrated in FIGS. 1-4.

Alternative embodiments include hydraulic actuators or other actuators known to those skilled in the art replacing the electric actuators 18, 20. Furthermore, smart materials or electroelastomers could be used instead of the elastomeric nozzle and articulation mechanism.

While the invention has been described in connection with what is considered to be the most practical and preferred embodiment, it should be understood that this invention is not to be limited to the disclosed embodiment, but on the contrary, is intended to cover various modifications and equivalent arrangements included within the spirit and scope of the appended claims.

What is claimed is:

1. A mechanism for controlling motion of a vehicle, said mechanism comprising:

a first linkage and a second linkage;

a first rod bearing and a second rod bearing, each of said rod bearings respectively connected radially to said first and second linkages;

a first rod and a second rod, each rod having a first end and a second end, the first end of each rod pivotally connected respectively to said first and second rod bearings;

a gimbal bearing having an exterior capable of being positioned within the vehicle and having a face to said first and second rods with said face including a first rod bearing and a second rod bearing in which the second end of each of said rods is pivotally connected respectively within said first and second rod bearings of said gimbal;

a shaft having a first end and a second end, said first end affixed to said gimbal bearing opposite to said face;

a hub encompassing a second end of said shaft;

a plurality of spaced-apart struts, each strut having a first end and a second end, said struts extending outward from said hub at the first end of each of said struts;

an elastomeric nozzle capable of encasing a propulsor flow of the vehicle with an inlet end capable of connection to a propulsor shroud of the vehicle and said nozzle further including an outlet end;

an annular ring having an interior connected to the second end of each of said struts with a first side of the interior facing an interior of said outlet end of said nozzle and opposite side of the interior of said ring facing rearward as a discharge for the propulsor flow, said annular ring having an exterior attached to said outlet of said nozzle; and wherein movement of said first and second linkages radially controls movement of said first and second rod bearings to pivotally move said first and second rods thereby impacting said first and second rod bearings of said gimbal for a movement of said gimbal with said hub, said elastomeric nozzle and said annular ring in a shared plane with the movement of said gimbal to provide thrust vectoring by rotating the propulsor flow rearward at an angle of the shared plane to a desired motion of the vehicle thereby controlling an actual motion of the vehicle.

2. The mechanism in accordance with claim 1 wherein the second end of each of said rods are rotatationally connected within said first and second rod bearings of said gimbal at a distance 90 degrees circumferentially to each other on said face.

3. The mechanism in accordance with claim 2 wherein said nozzle is fabricated from Navy red rubber and is supported by spiral-wound fiberglass-based composite wherein said nozzle is capable of maintaining a circular cross section through a range of motion.

4. The mechanism in accordance with claim 3 wherein said exterior of said gimbal bearing is an outer race movable on a bearing section of said gimbal bearing wherein said outer race is capable of constraint to rotation in a first axis by positioning of said gimbal bearing within the vehicle.

5. The mechanism in accordance with claim 4 wherein said gimbal bearing further comprises a radial pathway with a direction parallel to said shaft and wherein said mechanism further comprises a stud attachable with the vehicle, said stud positioned within said radial pathway to constrain the rotation of said gimbal bearing on a second axis about a center of said gimbal bearing in a plurality of planes that contain a centerline of the vehicle.

6. The mechanism in accordance with claim 5 wherein the plurality of planes are within a range of 25 degrees above the centerline of the vehicle to 25 degrees below the centerline of the vehicle.

7. The mechanism in accordance with claim 6 wherein a combination of movement on the first axis and the second axis constrains rotation of said gimbal within a volume contour of a cone with an included angle from the centerline of the cone to the surface of the cone being 25 degrees.

8. The mechanism in accordance with claim 7, said mechanism further comprising a first electric actuator and a second electric actuator mechanically attached to said first and second linkages wherein said first and second electric actuators respectively operationally control said first and second linkages.

9. The mechanism in accordance with claim 8 said mechanism further comprising a first clevis and second clevis, each of said actuators pivotally connected respectively with a U-shape of a yoke of each of the clevis with an opposite end of the yoke of each of the clevis radially connects respectively with said first and second linkages.

10. The mechanism in accordance with claim 9 said mechanism further comprising a sealed bulkhead encompassing a section of said first and second linkages wherein said clevis and actuators are isolated from an environment exterior to the vehicle when said sealed bulkhead is positioned within the vehicle.

11. The mechanism in accordance with claim 2 wherein said exterior of said gimbal bearing is an outer race movable on a bearing section of said gimbal bearing wherein said outer race is capable of constraint to rotation in a first axis by positioning of said gimbal bearing within the vehicle.

12. The mechanism in accordance with claim 11 wherein said gimbal bearing further comprises a radial pathway with a direction parallel to said shaft and wherein said mechanism further comprises a stud attachable with the vehicle, said stud positioned within said radial pathway to constrain the rotation of said gimbal bearing on a second axis about a center of said gimbal bearing in a plurality of planes that contain a centerline of the vehicle.

13. The mechanism in accordance with claim 12 wherein the plurality of planes are within a range of 25 degrees above the centerline of the vehicle to 25 degrees below the centerline of the vehicle.

14. The mechanism in accordance with claim 13 wherein a combination of movement on the first axis and the second axis constrains rotation of said gimbal within a volume contour of a cone with an included angle from the centerline of the cone to the surface of the cone being 25 degrees.

15. The mechanism in accordance with claim 14 said mechanism further comprising a first electric actuator and a second electric actuator wherein said first and second electric actuators operationally control said first and second linkages respectively.

16. The mechanism in accordance with claim 15 said mechanism further comprising a first clevis and second clevis, each of said actuators pivotally connected respectively with a U-shape of a yoke of each of the clevis with an opposite end of the yoke of each of the clevis radially connects respectively with said first and second linkages.

17. The mechanism in accordance with claim 16 said mechanism further comprising a sealed bulkhead encompassing a section of said first and second linkages wherein said clevis and actuators are isolated from an environment exterior to the vehicle when said sealed bulkhead is positioned within the vehicle.

* * * * *